United States Patent [19]

Privalov et al.

[11] 4,306,941

[45] Dec. 22, 1981

[54] DRY COKE QUENCHING APPARATUS

[76] Inventors: Vasily E. Privalov, ulitsa Galana, 5, kv. 13; Ivan G. Zubilin, ulitsa 23 avgusta, 18, kv. 15; Zoltan-Ivan I. Todavchich, ulitsa Nijutona, 123/22, kv. 48; Nikolai K. Kulakov, ulitsa Akademika Pavlova, 132, kv. 223; Adolf N. Silka, ulitsa Kostomarovskaya, 5/7, kv. 15; Alexandr N. Minasov, ulitsa Ivanova, 12/16, kv. 59, all of, Kharkov; Mikhail G. Ananievsky, ploschad Metallurgov, 5, kv. 15, Cherepovets; Naum E. Temkin, ulitsa Vologodskaya, 4, kv. 15, Cherepovets; Vyacheslav I. Solodkov, ploschad Metallurgov, 2, kv. 22, Cherepovets, all of U.S.S.R.

[21] Appl. No.: 167,389

[22] Filed: Jul. 8, 1980

Related U.S. Application Data

[62] Division of Ser. No. 882,159, Feb. 28, 1978, Pat. No. 4,211,607.

[51] Int. Cl.[3] ..... C10B 39/02

[52] U.S. Cl. ..... 202/228; 48/71; 48/200; 48/202; 201/39; 202/150

[58] Field of Search ..... 201/39, 38, 34; 202/227, 228, 121, 150; 48/71, 200, 202

[56] References Cited

U.S. PATENT DOCUMENTS

| | | | |
|---|---|---|---|
| 1,661,211 | 3/1928 | Wussow | 201/38 |
| 1,959,182 | 5/1934 | Tyrer | 201/38 X |
| 1,968,053 | 7/1934 | Odell | 201/36 |
| 2,997,426 | 8/1961 | Mansfield | 202/228 X |
| 3,434,932 | 3/1969 | Mansfield | 201/27 |
| 3,959,084 | 5/1976 | Price | 202/228 X |
| 4,134,794 | 1/1979 | Lorenz et al. | 201/34 |

FOREIGN PATENT DOCUMENTS

| | | | |
|---|---|---|---|
| 1085495 | 7/1960 | Fed. Rep. of Germany . | |
| 1380290 | 10/1964 | France . | |
| 162106 | 9/1964 | U.S.S.R. | 201/34 |
| 217359 | 5/1968 | U.S.S.R. . | |

OTHER PUBLICATIONS

Leobovich, P. E. et al., *Technologia Koksohimicheskogo Proizvdstva,* Metallurgy, 1966, pp. 210–211.

*Primary Examiner*—Frank W. Lutter
*Assistant Examiner*—Roger F. Phillips
*Attorney, Agent, or Firm*—Fleit & Jacobson

[57] ABSTRACT

A dry coke quenching process comprises the steps of preheating a coke from a coke oven to a temperature of not lower than 1200° C. by way of burning over its layer a combustible gas mixed with heated air, cooling the coke first to a temperature of not lower than 700° C. with a mixture of hydrocarbons and water vapor, and then with an inert gas to a temperature of from 200° to 250° C.

An apparatus for effecting the process of the invention comprises a chamber lined from inside with refractory brick and provided with a means for introducing a combustible gas and heated air to the upper part of the chamber and for discharging combustion gases therefrom. Provided in the middle part of the chamber are means intended for a heated mixture of hydrocarbons and water vapor to pass in therethrough and for a flow of the resultant gas containing hydrogen and carbon monoxide to escape therethrough.

In the lower part of the chamber there are provided inlet and outlet means for an inert cooling gas to pass in and out therethrough.

In the course of operation, coke, heated to a temperature of up to 1200° C., is passed to the middle part of the chamber wherein a flow of gas-steam mixture heated to a temperature of up to 700° C. is introduced in countercurrent relation to the flow of coke. Resulting from the process of conversion of hydrocarbons with water vapor is gas containing hydrogen and carbon monoxide. The blast-furnace coke with a temperature of not lower than 700° C. is passed from the middle part of the chamber to the lower part thereof wherein it is cooled to a temperature of 200° to 250° C. with a flow of circulating inert gas.

1 Claim, 1 Drawing Figure

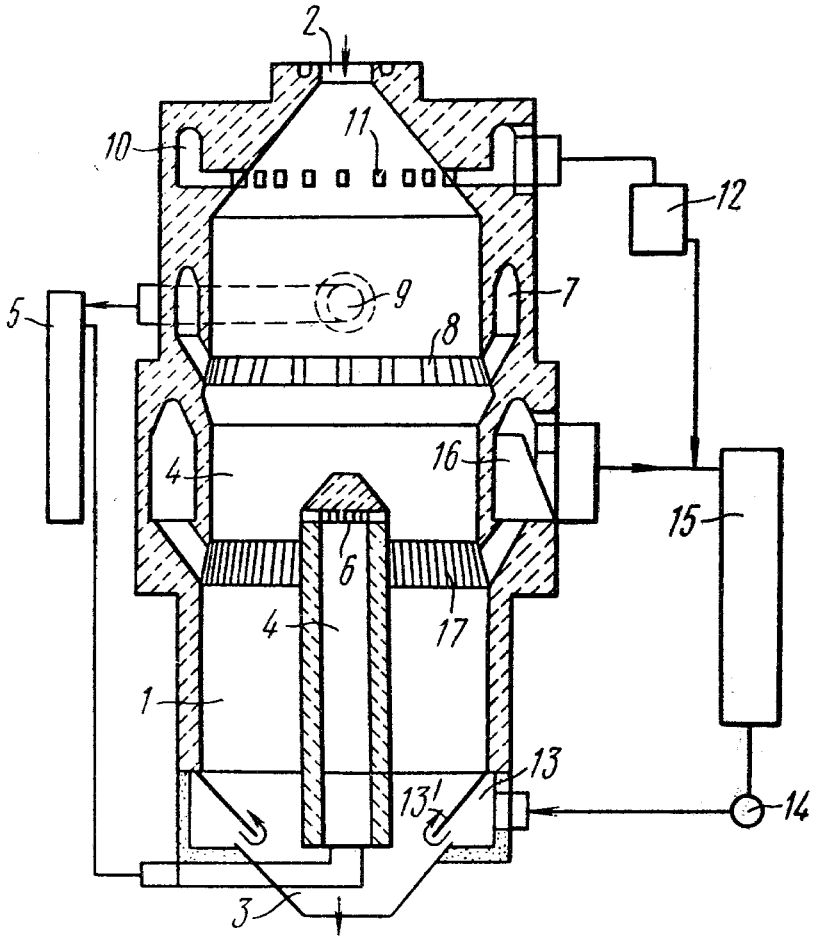
2
10
11
12
5
9
7
8
4
16
15
6
4
17
1
13
13'
14
3

DRY COKE QUENCHING APPARATUS

This is a divisional of application Ser. No. 882,159 filed Feb. 28, 1978, now U.S. Pat. No. 4,211,607.

BACKGROUND OF THE INVENTION

1. Field of the application

The present invention relates to methods of manufacturing high-grade metallurgical fuel, such as coke and gas containing hydrogen and carbon monoxide, and more particularly, to a dry coke quenching process and apparatus for effecting same.

A further growth in the production of pig iron and steel taking place in the industrially developed and developing countries, as well as the resultant higher consumption of coke, generate a need for new resources of coking coals. Limited reserves of high-grade coking coals and their high cost on the world market stimulate a search for new methods of effective utilization of organic mass of the coking coals for the use in the blast-furnace production.

In modern practice only 70 percent of the coking-coal organic mass is used for the blast-furnace process, while the remaining 30 percent is utilized in the form of solid, liquid and gaseous products for other needs or even in other branches of industry. Moreover, the coke obtained from coke ovens according to the production process now in use contains an appreciable amount of heat which formerly found no application and was released into the atmosphere together with steam formed in the process of dry quenching of said coke.

2. Description of the prior art

At the first stage of improvement of the coke production process a dry coke quenching process was developed wherein a sensible heat of coke was initially utilized for the production of the process steam and then of the energy-producing steam.

For example, there is known a dry coke quenching process ("Technologia koksokhemicheskogo proizvodstva", Coke Chemistry Engineering, published in 1966 by "Metallurgy" Publishing House, written by P. E. Leobovich ed altrum), according to which process the dry quenching of coke is effected by passing a flow of inert gas, such as nitrogen or products of combustion of coke or blast-furnace gases, into a dry quenching chamber.

There is also known an apparatus for carrying the abovementioned process into effect (USSR Inventor's Certificate Nos. 217, 359, ICI C 10b, H cl. 10a, 17/04; 10a 17/07).

Both the apparatus and process for dry quenching of coke suffer from a disadvantage which lies in low efficiency of the coke cooling process which necessitates larger working dimensions of, and, consequently, higher manufacturing cost for, dry coke quenching apparatus.

In addition, by using inert gases in the dry coke quenching process, the effectiveness of utilization of the coking-coal organic mass as well as the quality of coke remain unaltered with regard to its abrasion strength and sulphur-content characteristics.

The dry coke quenching process described in FRG Pat. No. 1,085,495, according to which dry quenching of coke is effected by a mixture of hydrocarbons, steam and oxygen or air, was the first attempt to improve the quality of coke by means of lowering sulphur content therein.

The dry coke quenching process according to the patent referred to above is carried out in a hopper provided with an inclined meshed bottom and adapted to receive therein incadescent coke from a plurality of coke ovens. Introduced from underneath through the meshed bottom is hydrocarbon-containing coke-oven gas and a mixture of steam and oxygen or steam and air. The interaction of hydrocarbons with oxygen and steam results in the formation of hydrogen on the surface of incadescent coke, necessary for its desulphurization, as well as in the evolution of additional amount of heat also required for the coke desulphurization. The content of sulphur in coke is thus lowered.

On escaping from the dry quenching chamber, the hot gas containing hydrogen and sulphur compounds is passed to a waste-heat boiler and then to a sulphur-absorption tower, whereupon, cooled and free from sulphur compounds, it is introduced together with the initial gas-steam mixture into the dry quenching chamber. The disadvantage of this method lies in low efficiency of the coke cooling process, resulting from additional liberation of heat upon interaction of oxygen with hydrocarbons of gaseous mixture and with hydrocarbon of coke. A low content of useful reducing components ($Co+H_2$) and a high content of inert constituents ($N_2$, $CO_2$ and $H_2O$), in the obtained gas renders the latter unsuitable for the use in the blast-furnace process.

The quality of coke as to its abrasion strength characteristics and the effectiveness of utilization of the coking-coal organic mass in the blast-furnace process remain unimproved. The apparatus for carrying into effect the above-described process suffers from constructional deficiencies; it is cumbersome and is, therefore, difficult to be appropriately positioned in modern coke shops furnished with large-capacity ovens.

French Pat. No. 1,300,290 teaches a method according to which dry quenching of coke is effected not by inert gases but by a mixture of hydrocarbons, steam and oxygen or air. Coke-oven gas is used as the hydrogen-containing gas in the cooling mixture. This method is considered to be the first attempt aimed at raising effectiveness of utilization of the coking-coal organic mass for employment in the blast-furnace process.

The apparatus for carrying the above-described method into effect is constructionally similar to that described in USSR Inventor's Certificate No. 217,239.

Resulting from the interaction of steam and oxygen with hydrocarbons is gas containing hydrogen and carbon monoxide. The use of gas (reducing gas) containing hydrogen and carbon monoxide in the blast-furnace process makes for lower consumption of coke and a higher production output of a blast furnace. Therefore, the effectiveness of utilization of the coking-coal organic mass in the blast-furnace process is somewhat increased.

The method of the patent referred to above, however, suffers from a disadvantage, it being low efficiency of the coke dry quenching process. The presence of oxygen in the cooling mixture, interacting with the hydrocarbons of gaseous mixture and with the hydrocarbon of coke, leads to additional liberation of heat and to lower rate of coke cooling. As a result, the working dimensions of, and the manufacturing cost for, the dry coke quenching apparatus are increased, whereas specific yield of gas containing hydrogen and carbon monoxide is decreased. Moreover, the quality of coke as to its abrasion strength and sulphur-content characteristics remains unimproved, whereas the coke yield is reduced due to its gasification by 1.6 to 2.0 percent.

SUMMARY OF THE INVENTION

It is an object of the invention to ensure highly effective cooling of coke as well as to enhance production efficiency of an apparatus for dry quenching of coke.

Another object of the invention is to improve quality of metallurgical coke as to its abrasion strength and sulphur-content characteristics.

Still another object of the invention is to increase specific yield of gas containing hydrogen and carbon monoxide per ton of dry quenched coke, as well as to improve its quality as to the content of useful reducing components ($\Sigma H_2+CO$).

These and other objects and features of the invention are accomplished by the provision of a dry coke quenching process comprising cooling the coke by flowing therethrough a mixture of hydrocarbons and water vapor whereby a gas is obtained which contains hydrogen and carbon monoxide, wherein, according to the invention, the coke is first preheated to a temperature of not lower than 1200° C., and then cooled initially to a temperature of not lower than 700° C. with said mixture being passed therethrough, subsequent cooling of coke to a temperature of not more than 200° C. being carried out by passing a flow of inert gas therethrough.

The dry coke quenching process according to the invention permits the coke cooling process to be stepped up due to a higher rate of heat removal per unit of working volume of a dry quenching chamber, thereby enhancing production efficiency of a dry coke quenching apparatus. In addition, the process of the invention makes it possible to improve the quality of coke as to its abrasion strength and sulphur-content characteristics due to additional heat treatment thereof, as well as to increase specific yield and improve quality of gas containing hydrogen and carbon monoxide, resulting from the process of intensified conversion of hydrocarbons with water vapor.

It is preferable that a mixture of hydrocarbons and water vapor is preheated to a temperature of not lower than 700° C. prior to being used for coke cooling.

The step of preheating the gas-steam mixture used for cooling has direct bearing on the intensification of the dry coke quenching process, since it substantially effects the rate of coke cooling and the depth of conversion of hydrocarbons with water vapor.

By cooling the coke with the mixture of hydrocarbons and water vapor, preheated to a temperature of 700° C., the removal of heat per unit of working volume of a dry quenching chamber is from 1.5 to 2.0 times higher than that when coke cooling is effected with a gas-steam mixture not previously heated.

With the gas-steam mixture being heated to the above-indicated temperature, the hydrocarbons contained therein will interact more intensively and completely with water vapor to be converted into useful constituents of reducing gas CO and $H_2$, thereby increasing the yield of said gas and improving its quality as to the content of CO and $H_2$.

It is highly preferable that the heating of coke is effected by way of burning a combustible gas thereabove.

The burning of combustible gas directly above the layer of coke permits the latter to be heated to a high temperature during a short period of time, thereby intensifying the process of heat transfer between the flame zone of gas and coke, as well as reducing 3 to 4 times the volume of the upper part of a dry quenching chamber.

The objects of the invention are also attained in an apparatus for effecting the dry coke quenching process, comprising a chamber provided with means for charging and discharging coke therefrom, an inlet means through which a mixture of hydrocarbons and water vapor is fed into said chamber, and a manifold for the removal of gas containing hydrogen and carbon monoxide, according to the invention, there are provided inlet and outlet means intended for a heat carrier to pass in and out of the upper part of said chamber and positioned above said manifold, the lower part of said chamber having disposed therein inlet and outlet means for an inert cooling gas to pass in and out therefrom, the inlet means for the passage of said mixture of hydrocarbons and water vapor being made in the form of a branch pipe positioned in the central part of said chamber and having its outlet opening disposed in the middle part of the chamber above the inert gas inlet and outlet means.

With the apparatus of the invention it becomes possible to perform highly efficient dry coke quenching process of improved quality, as well as to obtain a high yield of a highgrade reducing gas which contains useful constituents, such as $\Sigma H_2+CO$, required for the blast-furnace process.

The fact that the inlet means for the passage of said mixture of hydrocarbons and water vapor is made in the form of a branch pipe positioned in the central part of the chamber and having its outlet opening disposed in the middle part of the chamber above the inert gas outlet means makes possible uniform distribution of the in-going gas-steam mixture over the entire area of the middle part of the chamber. In addition, this allows the coke cooling process to be divided into two stages. At the first stage the cooling of coke is effected by passing a flow of gas-steam mixture, and by a flow of inert gases at the second stage. At each stage different coolants are used, which are discharged separately, thereby appreciably intensifying the coke cooling process as well as the process of conversion of hydrocarbons with water vapor at the first stage of the coke cooling operation.

The provision of inlet and outlet means intended for a heat carrier to pass in and out of the upper part of the chamber, as well as its arrangement or location above the gas outlet manifold, permits intensive heating of coke to be carried out at elevated temperatures in this part of the chamber and eliminates the possibility of mixture of the out-going heat carrier with the gas containing hydrogen and carbon monoxide.

The provision of the inlet and outlet means intended for a cooling inert gas to pass in and out of the chamber permits final cooling of coke to be carried out in the explosion-proof conditions, and prevents, pollution of air with toxic gases.

BRIEF DESCRIPTION OF THE DRAWING

The invention will be further described, by way of example only, with reference to the accompanying drawing which is a vertical schematic view of an apparatus for carrying into effect the dry coke quenching process according to the invention.

DETAILED DESCRIPTION OF THE PREFERRED EMBODIMENT

The apparatus, as shown in the drawing, comprises a dry quenching chamber 1 made in the form of a vertically extended cylinder-shaped pit provided with an externally fitted metal shell lined from the inside with several layers of refractory brick. The chamber 1 is provided with a means 2 for charging coke thereinto which is then subjected to cooling, and with a means 3 for discharging the cooled coke. The charging means 2 can be constructed in any conventional manner, for example, in the form of a hopper of rectangular cross section and formed with a tapered bottom and a gate (not shown). The discharging means 3 also can be constructed in any conventional manner, for example, in the form of a sluice gate (not shown).

Mounted in the chamber 1 along its vertical axis is an inlet means for introducing a mixture of hydrocarbons and water vapor, which is made in the form of a branch pipe 4 having its one end connected with a heat exchanger 5 of any conventional construction, for example, tubular, the other end thereof being disposed in the middle part of the chamber 1. The branch pipe 4 is formed of refractory brick and fitted with a tapered headpiece with slotted openings 6 being formed thereunder around the periphery of the branch pipe 4.

Mounted above the branch pipe 4 is a manifold intended for discharging the gas containing hydrogen and carbon monoxide, and made in the form of an annular passage 7 disposed in the middle part of the refractory lining of the chamber 1 and connected through slotted openings 8 to the interior of the chamber 1, and through an outlet duct 9 to the heat exchanger 5.

Mounted above the annular passage 7 is a means intended for a heat carrier to pass in and out therethrough and made in the form of an annular passage 10 disposed in the refractory lining of the upper part of the chamber 1 and having mounted in its interior transversely extending partitions which divide the annular passage 10 into substantially two equal parts. Each part of the annular passage 10 communicates with the interior of the chamber 1 through slotted openings 11, and also with a regenerator 12 of any conventional construction, such as a pit of rectangular cross section filled with a checkerwork and partitioned by a vertical wall also into two parts. Each part of the regenerator 12 communicates with only one part of the annular passage 10. The regenerator 12 and the checkerwork fitted in its interior are made of a refractory material.

In the lower part of the chamber 1 there is mounted a means for introducing into said chamber an inert cooling gas such as nitrogen or the products of combustion of the coke-oven gas. The gas introducing means is basically an annular passage such as shown at 13, having its one end brought in communication with the interior of the chamber 1 by means of a fire grate 13' of any conventional construction, for example, made in the form of gills, the other end of said annular passage 13 communicating with a waste-heat boiler through a gas blower 14. The annular passage 13 and the fire grate 13' are cast in steel.

Positioned above the annular passage 13 is a means intended for discharging inert gas and made in the form of an annular passage, such as shown at 16, disposed in the refractory lining of the chamber 1 and having its one end connected to the interior of the chamber 1 through slotted openings 17 and its other end to the waste-heat boiler 15. The slotted openings 17 of the annular passage 16 are arranged or located below the outlet openings 6 of the branch pipe 4.

The apparatus according to the invention operates in the following manner.

Coke obtained from a coke oven at 1000° to 1100° C. is fed through the means 2 into the upper part of the chamber 1 whereupon it is heated to a temperature of not lower than 1200° C. with a mixture of combustible gas, such as coke-oven gas preheated to a temperature of 1100° C., in the respective part of the air regenerator 12. From the regenerator 12 the heated air is fed to the interior of the chamber 1 along the respective part of the annular passage 10 through the slotted openings 11, the combustible gas being fed from an externally located gas manifold along connecting pieces (not shown).

The heating of coke is effected by way of radiant heat exchange between the flame zone of gas and coke. It is possible to carry out the heating of coke to a temperature of 1200° C. by any other conventional method. The proposed method, however, is advantageous in that the coefficient of the radiant heat exchange between the flame zone of gas and coke is 4 to 5 times the coefficient of the convective heat exchange between the flame zone of gas and coke, and 7 to 8 times the coefficient of the heat transfer from the heated wall to the coke in the event of heating the coke through the heated wall. Giving preference to the radiant heat exchange between the flame zone of gas and coke will allow the layer of coke to be heated to a temperature of not lower than 1200° C. for a time period corresponding to the time interval between the coke charging cycles. This makes it possible to reduce 3 to 4 times the volume of the upper part of the chamber 1 due to shorter residence time of coke in this part of the chamber 1.

The products of combustion, cooled to a temperature of not lower than 1200° C. as a result of their heat being given up to coke, are fed through the slotted openings 11 of the second half of the annular passage 10 to the respective part of the regenerator 12 to give up their heat to the checkerwork, and on being cooled to a temperature of not lower than 1200° C., said combustion products are flown to the wasteheat boiler 15. The direction of currents of combustion gases and air in the parts of the regenerator 12 and in the respective parts of the annular passage 10 is periodically changed at approximately half-hour intervals.

The coke, heated to a temperature of not lower than 1200° C., is brought down to the middle part of the chamber 1 whereinto a mixture of hydrocarbons and water vapor, preheated to a temperature of not lower than 700° C. in the intertubular space of the heat exchanger 5, is fed in counterflow along the branch pipe 4 and through the outlet openings 6. With the coke being preheated to a temperature of not lower than 1200° C. and the mixture of hydrocarbons and water vapor to a temperature of not lower than 700° C., the operating process is substantially intensified which, on the one hand, steps up the cooling rate of coke and enhances production efficiency of the dry coke quenching apparatus, since the conversion of hydrocarbons with water vapor is accompanied with an appreciable absorption of heat, and, on the other hand, makes possible the output of gas containing hydrogen and carbon monoxide to be increased along with useful constituents such as $\Sigma CO+H_2$. When the coke is cooled with a mixture of hydrocarbons and water vapor, preheated to 700° C., the rate of heat removal per unit volume of the chamber 1 is 1.5 to 2 times the rate of coke cooling effected by means of the unheated gas-steam mixture.

For example, the heat resulting from the endothermic reaction of conversion of the coke-oven gas hydrocarbons with water vapor is estimated at 162 kilocalories per kilogram of coke, which amounts to about 45 percent of the overall heat introduced with the coke preheated to 1200° C. Where conversion of the natural gas hydrocarbons is effected with water vapor, the heat effect is as high as 210 kilocalories per kilogram of coke, which amounts to about 60 percent of the overall heat introduced with coke preheated to 1200° C. The remaining 40 to 50 percent of heat given up by the coke heated to 1200° C. is used for heating the products of conversion, as well as for the production of the process steam required for the process of conversion. It has also been found that the conversion of the hydrocarbons contained in the gas-steam mixture proceeds at a rapid rate with the temperature of said mixture being above 700° C. At this temperature the hydrocarbons of the gas-steam mixture and water vapor react more intensively and completely to be converted into useful constituents of the reducing gas CO and $H_2$, thereby increasing the yield of this gas and the content of CO and $H_2$ therein.

Therefore, as a result of contact of said mixture with incadescent coke, the process of the steam conversion of hydrocarbons into gas containing hydrogen and carbon monoxide is intensified to thereby step up the rate of cooling coke to a temperature of not lower than 700° C.

The gas resulting from the steam conversion of hydrocarbons and containing hydrogen and carbon monoxide is fed at a temperature of 800° to 900° C. through the slotted openings 8 to the annular passage 7 and further along the outlet duct 9 to the tubes of the tubular heat exchanger 6 wherein it is cooled to a temperature of 250° to 280° C. and, upon final cooling and refining, is delivered to consumer.

After being cooled in the middle part of the chamber 1 to a temperature of 600° to 700° C., the coke is then brought down to the bottom part of the chamber 1 while a flow of cooling inert gas at 160°–180° is introduced from underneath in countercurrent relation to the flow of coke through the annular passage 13 and, on passing through the layer of the descending coke, is heated to a temperature of 500° to 600° C. due to the convective heat exchange with coke, whereas the latter is cooled to a temperature of 200° to 250° C. The flow of cooling inert gas at a temperature of 500° to 600° C. is passed through the slotted openings 17 to the annular passage 16 and further on to the waste-heat boiler 15 to be cooled therein to a temperature of 160° to 180° wherefrom it is recycled to the bottom part of the chamber 1 by means of the gas blower 14 for the purpose of coke cooling.

Thus, the inert cooling gas is in constant circulation between the bottom part of the chamber 1 and the waste-heat boiler 15. Additionally introduced into the waste-heat boiler 15 from the regenerator 12 are combustion gases heated to a temperature of 500° C., which are first cooled therein to a temperature of 160° to 180° C. and then are released to the atmosphere.

The invention will be further described with reference to the following illustrative Example.

Example

A pit-coal coke was cooled in the dry quenching chamber 1, said coke having the following characteristics:

| | |
|---|---|
| initial temperature | from 1000 to 1100° C. |
| WRI $M_{10}$ | from 5.8 to 6.2 percent |
| Sulphur-content in coke, S | from 1.78 to 1.82 percent |

The pit-coal coke with a temperature of 1000°–1100° C. was heated in the upper part of the chamber 1 by burning over its layer a coke-oven gas of the following composition, in percent by volume: $CH_4$, 25; $H_2$, 60; $C_mH_n$, 2; $CO_2$, 2; CO, 7; $N_2$, 4.

Specific consumption of the coke-oven gas was 0.035 cubic meter per kilogram of coke, and the flow rate of air heated to 1100° C. and supplied to enable burning of coke was 0.16 cubic meter per kilogram of coke having a temperature of 1200° C., are passed to the regenerator 12 to be cooled therein to a temperature of 500° C., whereupon they are passed to the waste-heat boiler 15.

The flow of coke heated to a temperature of 1200° C. in the upper part of the chamber 1 is passed to the middle part of this chamber, while a flow of cooling gas-steam mixture preheated in the heat exchanger 5 to a temperature of 700° C. is passed in counterflow through the branch pipe 4 and the openings 6.

The flow rate of the gas-steam mixture used for the process of conversion and that of coke cooling is 0.6 cubic meter per kilogram of coke.

The hydrocarbon-containing gas present in the cooling gas-steam mixture is a coke-oven gas of the composition similar to that indicated above, said gas being introduced at a volume ratio of steam to hydrocarbons as 1.05 to 1.10, respectively. The time contact of the gas-steam mixture and incandescent coke was in the range of from 10 to 15 seconds.

As the hydrocarbons are subjected to conversion with the aid of steam, the coke is cooled to a temperature of 700° C. while the gas-steam mixture is converted into gas containing hydrogen and carbon monoxide (reducing gas), said constituents being present in the gas in an amount of 94 to 95 percent by volume. Specific yield of gas containing hydrogen and carbon monoxide is 0.7 cubic meter per kilogram of the dry quenched coke. From the middle part of the chamber 1 the coke, having a temperature of 700° C., is delivered to the lower part of the chamber 1 to be cooled therein to a temperature of 200° to 250° C. with an inert gas fed with a temperature of 160°–180° C. to this part of the chamber from the waste-heat boiler 15 through the annular passage 13. The products of combustion of the coke-oven gas are used as the cooling inert gas having the following composition, in percent by volume: $CO_2$, 1.9; CO, 1.8; $H_2$, 0.4; $O_2$, 2.8; $N_2$,76.

The consumption of combustion gases required for the final quenching of coke is 1.6 cubic meters per kilogram of coke.

By carrying out the preheating of the gas-steam mixture from 80°–100° C. up to 700°–750° C., as well as that of coke from 1000°–1100° C. up to 1200°–1300° C., it becomes possible to improve the strength of coke, i.e. to lower the coke abrasion strength index ($M_{10}$) from 5.8–6.2 percent to 4.8–5.0 percent, to reduce sulphur-content in coke (S) from 1.78–1.82 to 1.5–1.55 percent, to increase the content of useful constituents in the gas containing hydrogen and carbon monoxide ($\Sigma H_2+CO$) from 87–89 to 94–95 percent by volume, to raise specific yield of the gas in question from 0.3 to 0.7 cubic meter per kilogram of coke, and to enhance 2.2 to 2.3 times the production efficiency of the dry coke quenching apparatus of the invention as to the amount of dry-quenched coke.

From the above it follows that the process according to the invention for dry quenching of coke will permit, on the one hand, effective utilization of the coking coal in the blast-furnace process, will allow the quality of blast-furnace coke to be improved with the resultant lower consumption of coke used in the blast-furnace process; permitting, on the other hand, part of the coke-oven gas to be converted into a gas containing hydrogen and carbon monoxide, which, when used in the blast-furnace process, enables the consumption of coke to be lowered and the blast-furnace production output to be raised.

What is claimed is:

1. An apparatus for carrying out a dry coke quenching process, comprising a vertically elongated chamber with coke charging and discharging means located in upper and lower portions, respectively, inlet and outlet means in the upper portion of said chamber for a heat carrier to pass into and out of, respectively, the upper portion of said chamber, a manifold permitting the escape of gas containing hydrogen and carbon monoxide positioned below said heat carrier inlet and outlet means, a inlet means for the passage of a mixture of hydrocarbons and water vapor into said chamber in the form of a branch pipe positioned in a central portion of said chamber and having its outlet opening located along the vertical axis of said chamber and positioned in the middle portion of said chamber, and inlet and outlet means for the passage of inert gas into and out of, respectively, the lower portion of said chamber.

* * * * *